US008212747B2

(12) United States Patent
Handa et al.

(10) Patent No.: US 8,212,747 B2
(45) Date of Patent: Jul. 3, 2012

(54) IMAGE DISPLAY DEVICE

(75) Inventors: Tomoaki Handa, Tokyo (JP); Katsuhide Uchino, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 505 days.

(21) Appl. No.: 12/457,452

(22) Filed: Jun. 11, 2009

(65) Prior Publication Data

US 2010/0007583 A1 Jan. 14, 2010

(30) Foreign Application Priority Data

Jul. 10, 2008 (JP) ..... 2008-179723

(51) Int. Cl.
*G09G 3/30* (2006.01)

(52) U.S. Cl. ..... 345/76; 345/92; 345/95; 345/210; 345/212

(58) Field of Classification Search ..... 345/55, 345/76–80, 90–100, 204–215; 315/169.1–169.4
See application file for complete search history.

(56) References Cited

U.S. PATENT DOCUMENTS 6,356,026 B1 * 3/2002 Murto ..... 315/111.81
6,693,388 B2 * 2/2004 Oomura ..... 315/169.3

FOREIGN PATENT DOCUMENTS

| | | | |
|---|---|---|---|
| JP | 2007-133284 | | 5/2007 |
| JP | 2007-310311 | | 11/2007 |
| JP | 2008-287139 | A | 11/2008 |
| JP | 2009-139928 | A | 6/2009 |
| JP | 2009-186583 | A | 8/2009 |
| JP | 2009-271320 | A | 11/2009 |
| JP | 2009-288749 | A | 12/2009 |
| JP | 2010-014748 | A | 1/2010 |
| JP | 2010-014749 | A | 1/2010 |

OTHER PUBLICATIONS

Japanese Office Action issued Jul. 6, 2010 for corresponding Japanese Application No. 2008-179723.

* cited by examiner

*Primary Examiner* — Vijay Shankar
(74) *Attorney, Agent, or Firm* — Rader Fishman & Grauer, PLLC

(57) ABSTRACT

Disclosed herein is an image display device including a display section formed by arranging pixel circuits in a matrix form. Each pixel circuit includes at least a light emitting element, a drive transistor, a holding capacitor, and a write transistor. A light emission and non-light emission periods are alternately repeated. A light emission period start voltage and a non-light emission period start voltage are alternately output to the signal line. The terminal voltage of the holding capacitor is set to start the light emission and non-light emission periods. The write signal is set to sequentially delay the timings. The power drive signal is set in units of a plurality of successive lines. The drain voltage of the drive transistor is pulled up to high level at a time other than when the one of the terminals is connected to the signal line by the write signal in different lines.

5 Claims, 13 Drawing Sheets

IMAGE DISPLAY DEVICE

BACKGROUND OF THE INVENTION

1. Field of the Invention

The present invention relates to an image display device and is applicable, for example, to an active matrix image display device using organic EL (Electro Luminescence) elements. The present invention pulls a power drive signal up to high level at a time other than when a write signal is high. This permits the gray level to be set properly for each pixel circuit even if pixel circuit control using scan lines is shared among a plurality of lines.

2. Description of the Related Art

Recent years have seen the brisk development of active matrix image display devices using organic EL elements as their light-emitting elements. Here, the term "active matrix image display devices using organic EL elements" refer to image display devices which rely on light emission from an organic thin film when the film is applied with an electric field. These elements can be driven by a small voltage of 10 V or less, providing reduced power consumption. Further, these elements are self-luminous. As a result, this type of image display devices may require no backlight, permitting easy reduction of weight and thickness. Further, organic EL elements offer extremely high response speed or approximately several μseconds. As a result, this type of image display devices produces almost no afterimage during display of a moving image.

More specifically, active matrix image display devices using organic EL elements have a display section made up of pixel circuits arranged in a matrix form. Each of the pixel circuits includes an organic EL element and drive circuit adapted to drive the organic EL element. In this type of image display devices, the pixel circuits are driven by a signal drive circuit and scan line drive circuit provided around the display section via signal lines and scan lines provided in the display section to display a desired image.

A method of configuring a pixel circuit using two transistors is disclosed in Japanese Patent Laid-Open No. 2007-310311 (referred to as Patent Document 1 hereinafter) in relation to such an image display device using organic EL elements. Therefore, the method disclosed in Patent Document 1 permits simplification of the configuration of the image display device. Further, a configuration is disclosed in Patent Document 1 which prevents image quality degradation. Image quality degradation is caused by the variations in threshold voltage and mobility of the drive transistor adapted to drive the organic EL element and characteristic changes of the light-emitting element over time.

Japanese Patent Laid-Open No. 2007-133284 (referred to as Patent Document 2 hereinafter) proposes a configuration adapted to correct the variation in threshold voltage of the drive transistor in a plurality of steps. The configuration disclosed in Patent Document 2 makes it possible to assign a sufficient amount of time to the correction of the variation in threshold voltage even in the event that a shorter time is available for setting the gray level of the pixel circuits as a result of precision enhancement. This prevents image quality degradation due to variation in threshold voltage even in the event that improved precision is achieved.

SUMMARY OF THE INVENTION

Incidentally, if, in this type of image display devices, pixel circuit control using scan lines can be shared among a plurality of lines, the scan line drive circuit can be simplified in configuration.

However, the scan and signal lines intersect each other in this type of image display devices. Therefore, sharing pixel circuit control using scan lines among a plurality of lines leads to higher coupling capacitance between the signal lines and each scan line to be driven. This changes the signal line potential when the scan line is driven. As a result, it may be impossible to set the gray level properly for the pixel circuits.

The present invention has been made in light of the foregoing, and it is a desire of the present invention to propose an image display device for permitting proper setting of the gray level for the pixel circuits even if pixel circuit control using scan lines is shared among a plurality of lines.

In order to solve the above problem, an image display device to which the present invention is applied has a display section which includes pixel circuits arranged in a matrix form. Each of the pixel circuits includes at least a light-emitting element, drive transistor, holding capacitor and write transistor. The drive transistor current-drives the light-emitting element with a drive current commensurate with a gate-to-source voltage in response to a power drive signal applied to the drain thereof via a power scan line. The holding capacitor holds the gate-to-source voltage. The write transistor is controlled by a write signal supplied via a write signal scan line to connect one of the terminals of the holding capacitor to a signal line, thus setting the terminal voltage of the holding capacitor to a signal line voltage. Two periods, i.e., a light emission period during which the light-emitting element emits light, and non-light emission period during which the light-emitting element does not emit light, are alternately repeated. Two voltages, i.e., a light emission period start voltage adapted to at least start the light emission period, and a non-light emission period start voltage adapted to start the non-light emission period, are alternately output to the signal line. The terminal voltage of the holding capacitor is set by controlling the write transistor using the write signal, thus starting the light emission period and non-light emission period. The write signal is set in such a manner as to sequentially delay the timings at which to set the light emission period start voltage between successive lines. The power drive signal is commonly set in units of a plurality of successive lines. The drain voltage of the drive transistor is pulled up to high level using the power drive signal at a time other than when the one of the terminals of the holding capacitor is connected to the signal line by the write signal in the pixel circuits in different lines.

The light emission and non-light emission periods are initiated by controlling the write transistor and setting the light emission and non-light emission period start voltages, output to the signal line, to the terminal voltage of the holding capacitor. This permits sharing of control via the scan lines other than the write signal scan line among a plurality of lines. As a result, the write signal is set in such a manner as to sequentially delay the timings at which to set the light emission period start voltage between successive lines. Also, the power drive signal is commonly set in units of a plurality of successive lines. This provides simpler configuration for the each plurality of lines as a result of sharing of the power drive signal. Further, the drain voltage of the drive transistor is pulled up to high level using the power drive signal at a time other than when one of the terminals of the holding capacitor is connected to the signal line by the write signal in the pixel circuits in other lines. This avoids an increase in crosstalk in the signal line which would otherwise result from sharing of the power drive signal among a plurality of successive lines, making it possible to set the signal line potential to the terminal voltage of the holding capacitor. As a result, the gray level can be set properly for the pixel circuits even if pixel circuit control using the scan lines is shared among a plurality of lines.

The present invention permits proper setting of the gray level for the pixel circuits even if pixel circuit control using the scan lines is shared among a plurality of lines.

DETAILED DESCRIPTION OF THE PREFERRED EMBODIMENTS

The preferred embodiments of the present invention will be described below with reference to the accompanying drawings as appropriate.

Embodiment 1

(1) Configuration of the Embodiment (1-1) Overall Configuration

Figures 1A, 1B, 1C, 1D, 1E, 1F, 1G, 1H, 1I:
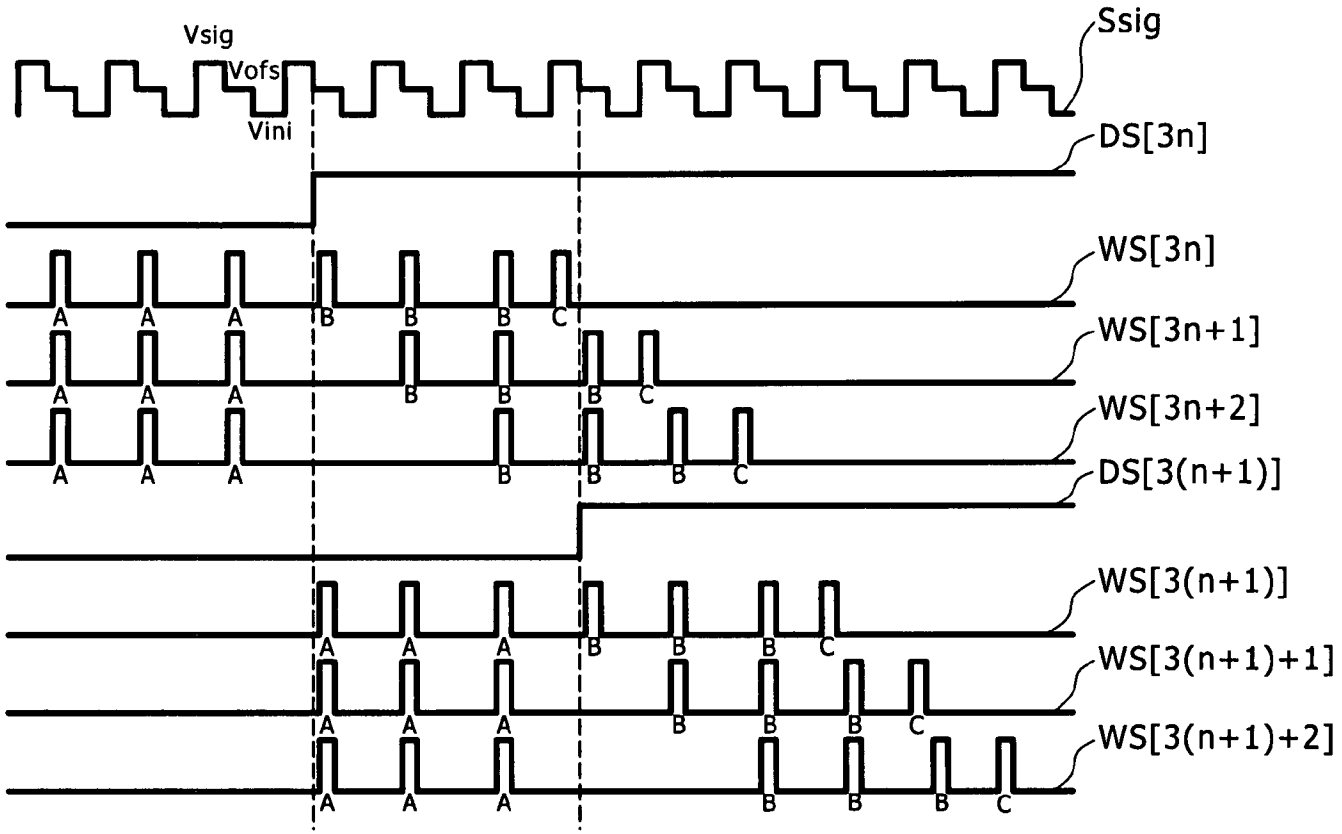
FIGS. 1A to 1I are timing diagrams for describing the operation of an image display device according to an embodiment of the present invention.
Figure 2:
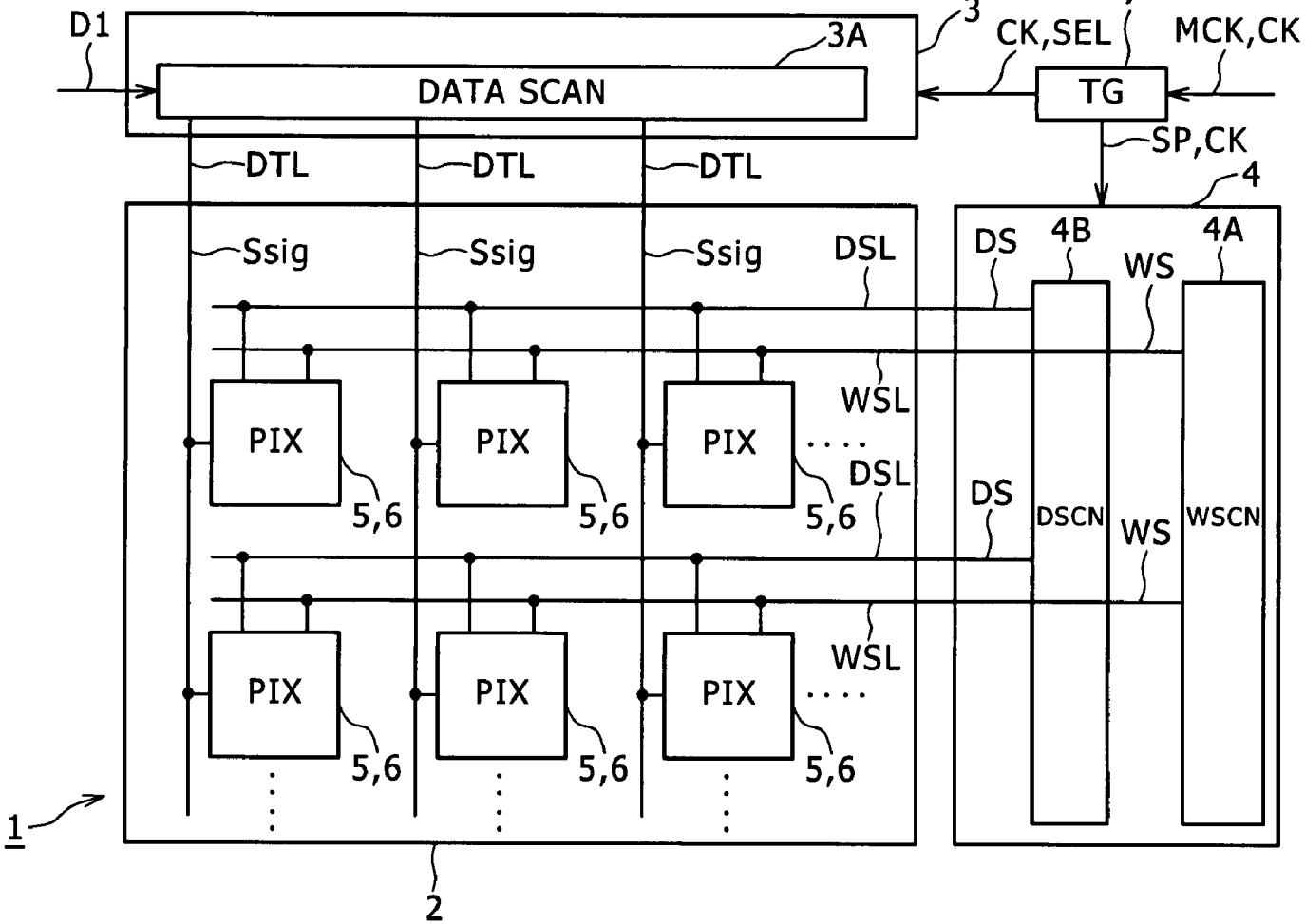
FIG. 2 is a connection diagram illustrating the image display device according to an embodiment of the present invention.

FIG. 2 is a block diagram illustrating an image display device according to this embodiment. An image display device 1 has a display section 2 formed on an insulating substrate made, for example, of glass. In the image display device 1, a signal line drive circuit 3 and scan line drive circuit 4 are formed around the display section 2.

The display section 2 has pixel circuits 5 arranged in a matrix form. Each of the pixel circuits 5 includes a pixel (PIX) 6. A timing generator (TG) 7 receives a master clock MCK, clock CK and other signals. The master clock MCK is synchronous with a vertical synchronizing signal. The clock CK is synchronous with image data D1. The timing generator 7 processes these signals and outputs a predetermined sampling pulse SP, the clock CK, a selector control signal SEL and other signals.

The scan line drive circuit 4 outputs a write signal WS and power drive signal DS respectively to write signal scan lines WSL and power scan lines DSL. Here, the write signal WS refers to a signal adapted to turn the write transistor in the pixel circuit 5 on or off. Further, the power drive signal DS refers to a signal adapted to control the drain voltage of the drive transistor in the pixel circuit 5. The scan drive circuit 4 includes a write scan circuit (WSCN) 4A and drive scan circuit (DSCN) 4B. The two scan circuits 4A and 4B process the predetermined sampling pulse SP with the clock CK to generate the write signal WS and power drive signal DS, respectively.

The signal line drive circuit 3 outputs a drive signal Ssig to signal lines DTL disposed in the display section 2.

Figure 3:
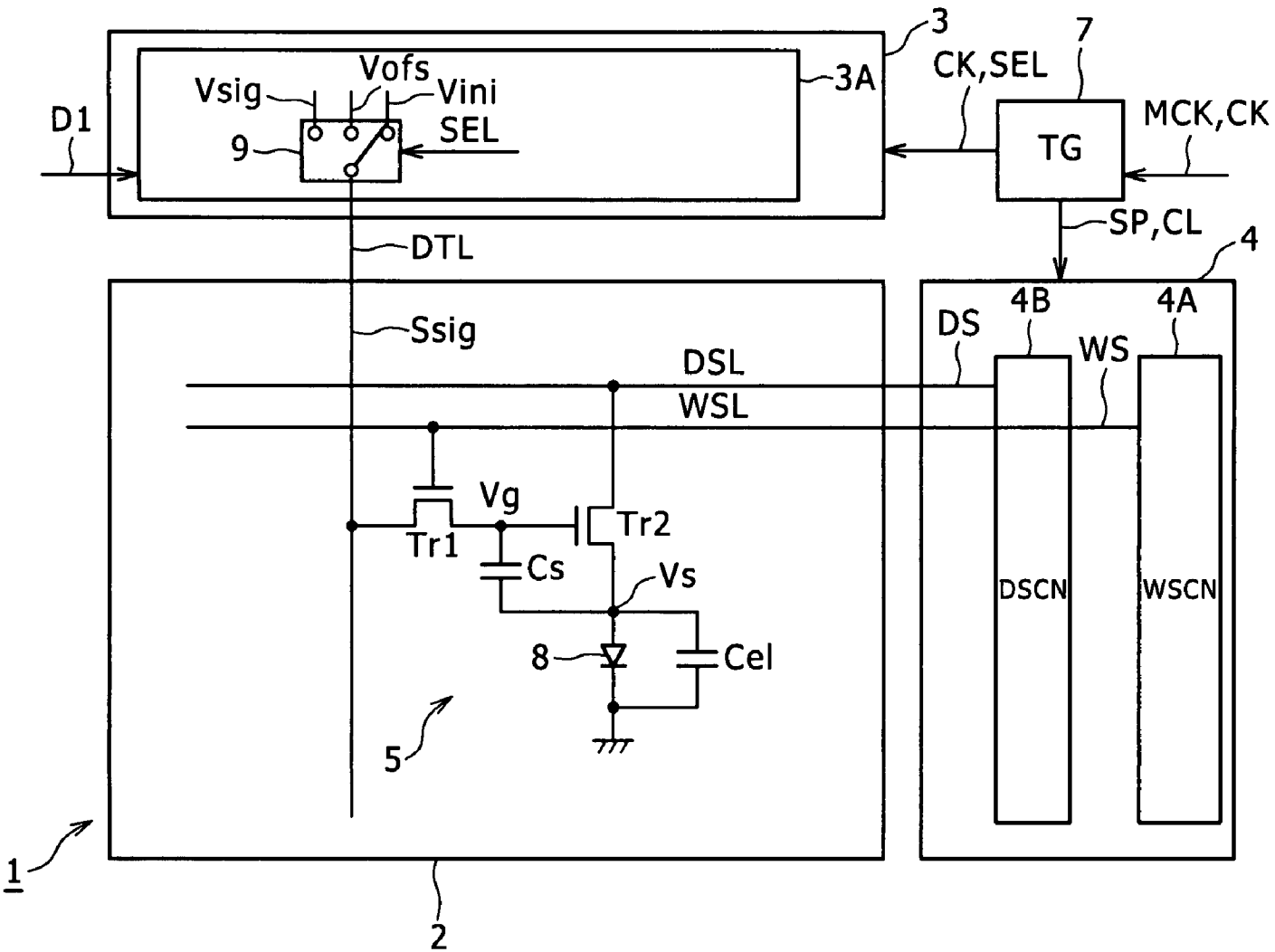
FIG. 3 is a connection diagram illustrating a pixel circuit of the image display device shown in FIG. 2.

More specifically, as illustrated in FIG. 3, the signal line drive circuit 3 uses a data scan circuit 3A to sequentially latch image data D1 which is input in order of raster scan sequence, divide the image data D1 among the signal lines DTL and convert each piece of the digital image data D1 into analog data, thus generating a gray level voltage Vin. Therefore, the gray level voltage Vin is associated with the image data D1. The data scan circuit 3A adds a fixed voltage Vofs for variation correction to the gray level voltage Vin to generate a gray level adjustment voltage Vsig (=Vin+Vo). It should be noted that the fixed voltage Vofs for variation correction is a voltage used to correct the variation in threshold voltage of the drive transistor which will be described later.

Figures 4A, 4B, 4C, 4D, 4E, 4F:
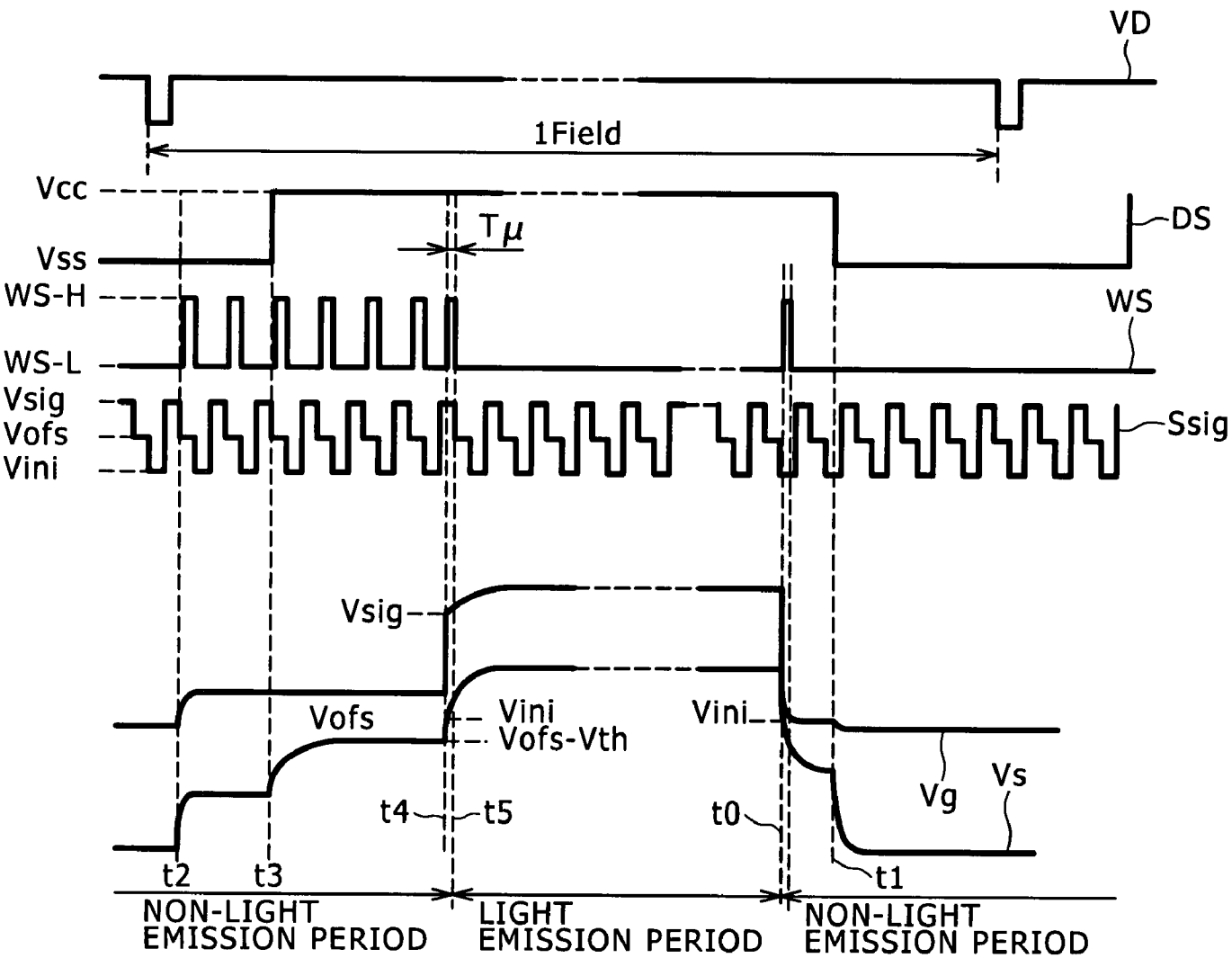
FIGS. 4A to 4F are timing diagrams for describing the operation of the pixel circuit shown in FIG. 3.

The data scan circuit 3A uses a selector 9 to output one of three voltages, i.e., the gray level setting voltage Vsig, fixed voltage Vofs for variation correction and extinguishing reference voltage Vini, to the signal lines DTL sequentially in a cyclic manner (refer to FIG. 4D). It should be noted that the extinguishing reference voltage Vini is a reference voltage adapted to cause the pixel circuits 5 to stop emitting light. The same voltage Vini is sufficiently lower than the fixed voltage Vofs for variation correction. The extinguishing reference voltage Vini is equal to or lower than the sum of three voltages, i.e., a cathode voltage Vcat and threshold voltage Vthel of an organic EL element 8 and a threshold voltage Vth of a drive transistor Tr2. This makes it possible for the image display device 1 to set the gray level for the pixel circuits 5 in a so-called line sequential manner.

In the pixel circuit 5, the organic EL element 8 has its cathode connected to a predetermined negative power source. In the example shown in FIG. 3, the negative power source is set to the ground potential. The organic EL element 8 has its anode connected to the source of the drive transistor Tr2. It should be noted that the drive transistor Tr2 is, for example, an N-channel TFT. The drive transistor Tr2 has its drain connected to the scan line DSL. The power drive signal DS is supplied to the scan line DSL from the scan line drive circuit 4. This makes it possible for the pixel circuit 5 to current-drive the organic EL element 8 using the drive transistor Tr2 having a source follower configuration.

In the pixel circuit 5, a holding capacitor Cs is provided between the gate and source of the drive transistor Tr2. The write signal WS sets the gate-side terminal voltage of the holding capacitor Cs to the voltage of the drive signal Ssig. As a result, the drive transistor Tr2 of the pixel circuit 5 current-drives the organic EL element 8 with a gate-to-source voltage Vgs commensurate with the drive signal Ssig. It should be noted that a capacitance Cel in FIG. 3 is the parasitic capacitance of the organic EL element 8. In the description given below, we assume that the capacitance Cel is sufficiently larger than the capacitance of the holding capacitor Cs, and that the parasitic capacitance of the gate node of the drive transistor Tr2 is sufficiently smaller than the capacitance of the holding capacitor Cs.

The gate of the drive transistor Tr2 is connected to the signal line DTL via a write transistor Tr1 which turns on or off in response to the write signal WS. Here, the write transistor is, for example, an N-channel TFT.

Figure 5:
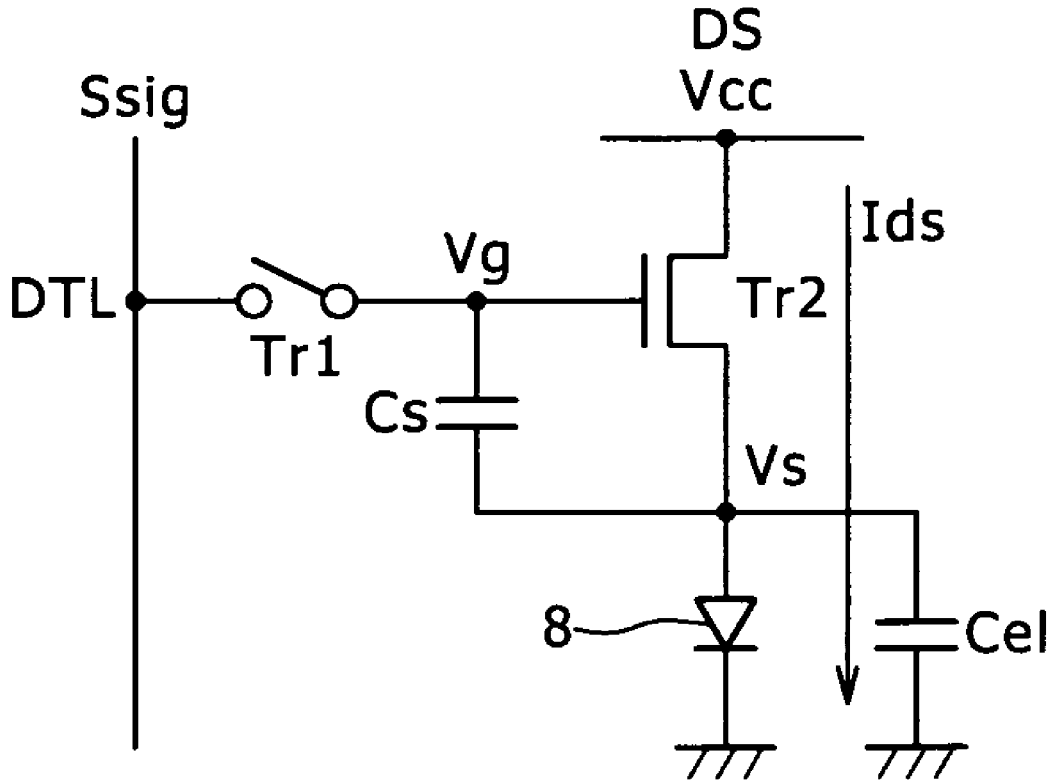
FIG. 5 is a connection diagram for describing the timing diagram shown in FIG. 4.
Figure 6:
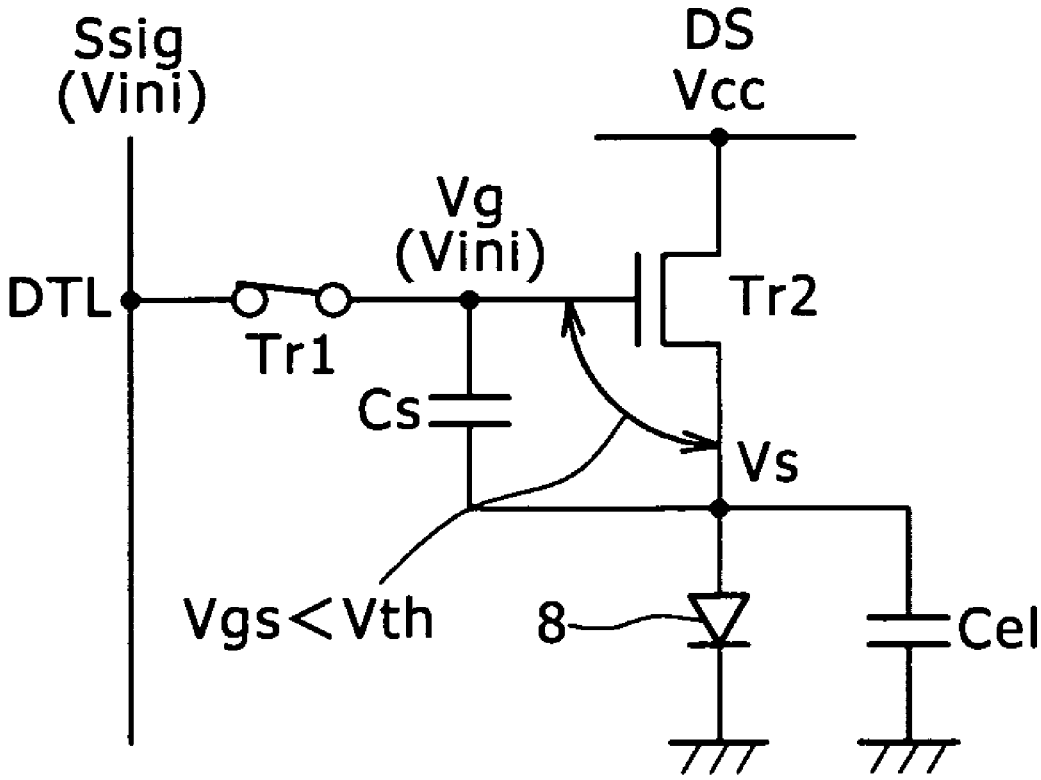
FIG. 6 is a connection diagram for describing the timing diagram continued from FIG. 5.

As illustrated in FIG. 4, the write transistor Tr1 is turned off by the write signal WS (FIGS. 4A and 4C), and a source voltage Vcc supplied to the drive transistor Tr2 by the power drive signal DS (FIG. 4B) during the light emission period of the organic EL element 8. This causes the organic EL element 8 to emit light in response to a drive current Ids commensurate with the gate-to-source voltage Vgs (FIGS. 4E and 4F) of the drive transistor Tr2 as illustrated in FIG. 5. The same voltage Vgs is the voltage across the holding capacitor Cs.

At time t0 when the light emission time ends, the write signal WS is pulled up to high level, turning on the write transistor Tr1 and setting the terminal voltage of the holding capacitor Cs to the extinguishing reference voltage Vini. This brings the voltage across the holding capacitor Cs down to the threshold voltage Vth of the drive transistor Tr2 or less, causing the same transistor Tr2 to stop driving the organic EL element 8.

Next, at time t1, the power drive signal DS is pulled down to a predetermined fixed voltage Vss (FIG. 4B). Here, the fixed voltage Vss is sufficiently low for the drain of the drive transistor Tr2 to function as a source, and is lower than the cathode voltage of the organic EL element 8.

Figure 7:
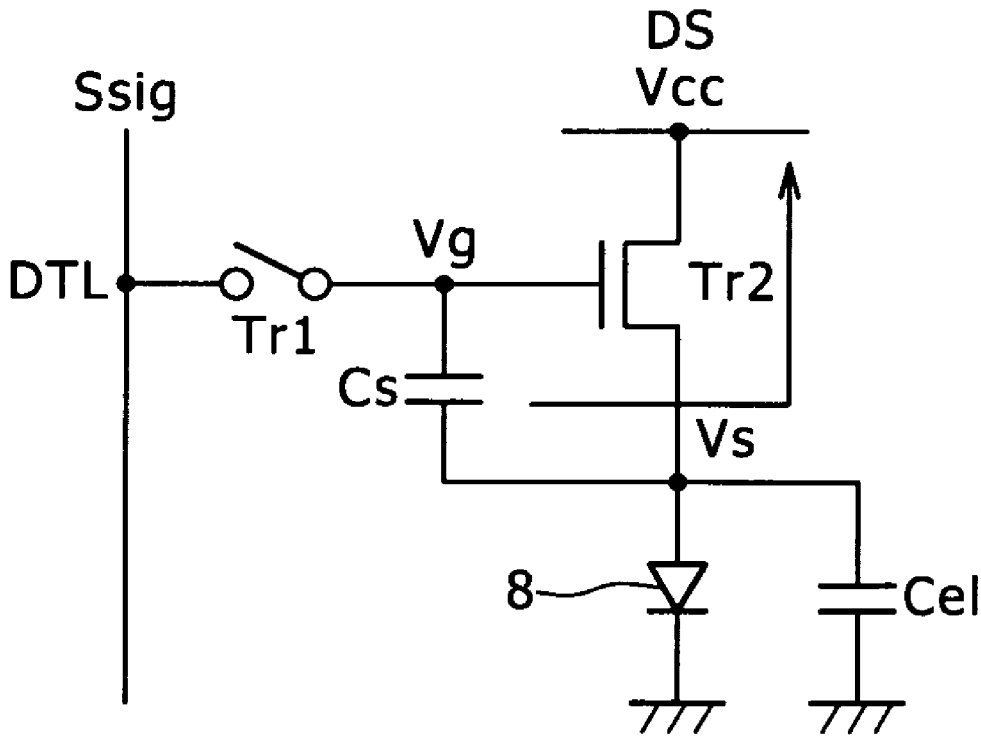
FIG. 7 is a connection diagram for describing the timing diagram continued from FIG. 6.

As a result, the stored charge of the holding capacitor Cs flows into the power scan line from the terminal of the same capacitor Cs on the side of the organic EL element 8 via the drive transistor Tr2 as illustrated in FIG. 7. This pulls the source voltage Vs of the drive transistor Tr2 down almost to the voltage Vss (FIG. 4F). As the source voltage Vs is pulled down, a gate voltage Vg of the drive transistor Tr2 drops (FIG. 4E).

Figure 8:
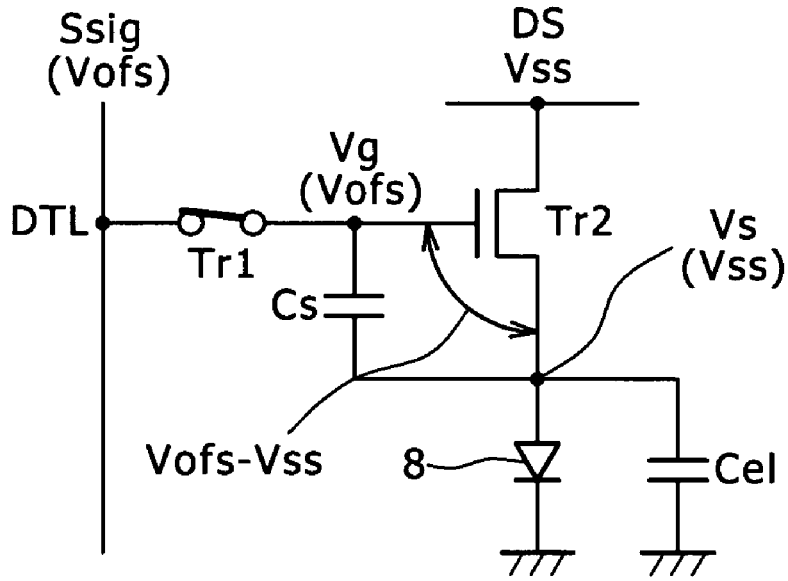
FIG. 8 is a connection diagram for describing the timing diagram continued from FIG. 7.

Next, at time t2, the write transistor Tr1 is turned on by the write signal WS (FIG. 4C). This sets the gate voltage Vg of the drive transistor Tr2 to the fixed voltage Vofs for threshold voltage correction (FIGS. 4D and 4E). The fixed voltage Vofs is the voltage level to which the signal line DTL is set. As a result, the gate-to-source voltage Vgs of the drive transistor Tr2 is set to the voltage Vofs-Vss as illustrated in FIG. 8. Here, the voltages Vofs and Vss are set so that the voltage Vofs-Vss is larger than the threshold voltage Vth of the drive transistor Tr2.

Then, at time t3, the drain voltage of the drive transistor Tr2 is pulled up to the source voltage Vcc by the power drive signal DS (FIG. 4B), and the signal line DTL is set to the fixed voltage Vofs. During a period of time in which the drain voltage and signal line DTL are respectively set to the source voltage Vcc and fixed voltage Vofs, the write transistor Tr1 is turned on (FIG. 4C). This causes the charge current Ids to flow into the terminal of the holding capacitor Cs on the side of the organic EL element 8 from the power source Vcc via the drive transistor Tr2. As a result, the voltage Vs of the terminal of the holding capacitor Cs on the side of the organic EL element 8 increases gradually. In this case, the current Ids flowing into the organic EL element 8 via the drive transistor Tr2 is used to charge the capacitance Cel of the organic EL element 8 and the holding capacitor Cs. This simply pushes up the source voltage Vs of the drive transistor Tr2 without any light emission of the organic EL element 8.

Figure 9:
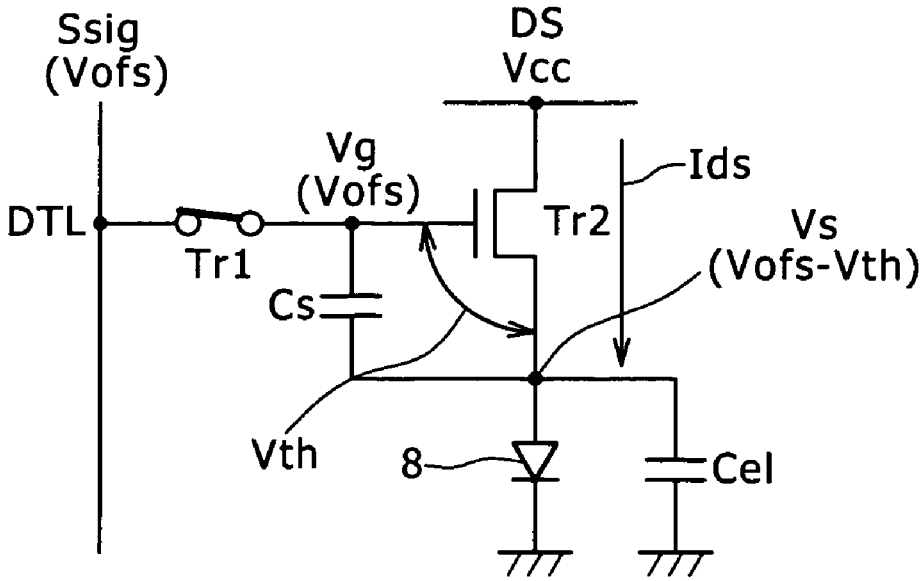
FIG. 9 is a connection diagram for describing the timing diagram continued from FIG. 8.

Here, if the voltage across the holding capacitor Cs becomes equal to the threshold voltage Vth of the drive transistor Tr2, the charge current Ids stops flowing through the drive transistor Tr2. In this case, therefore, the source voltage Vs of the drive transistor Tr2 stops increasing when the voltage across the holding capacitor Cs becomes equal to the threshold voltage Vth of the same transistor Tr2. This discharges the voltage across the holding capacitor Cs, setting the voltage across the same capacitor Cs to the threshold voltage Vth of the drive transistor Tr2 as illustrated in FIG. 9.

It should be noted that, in the example shown in FIG. 4, the charge current Ids is caused to flow into one of the terminals of the holding capacitor Cs via the drive transistor Tr2 in a plurality of steps. This ensures that the pixel circuit 5 has enough time to set the voltage across the holding capacitor Cs to the threshold voltage Vth of the drive transistor Tr2, even if high resolution is achieved.

Figure 10:
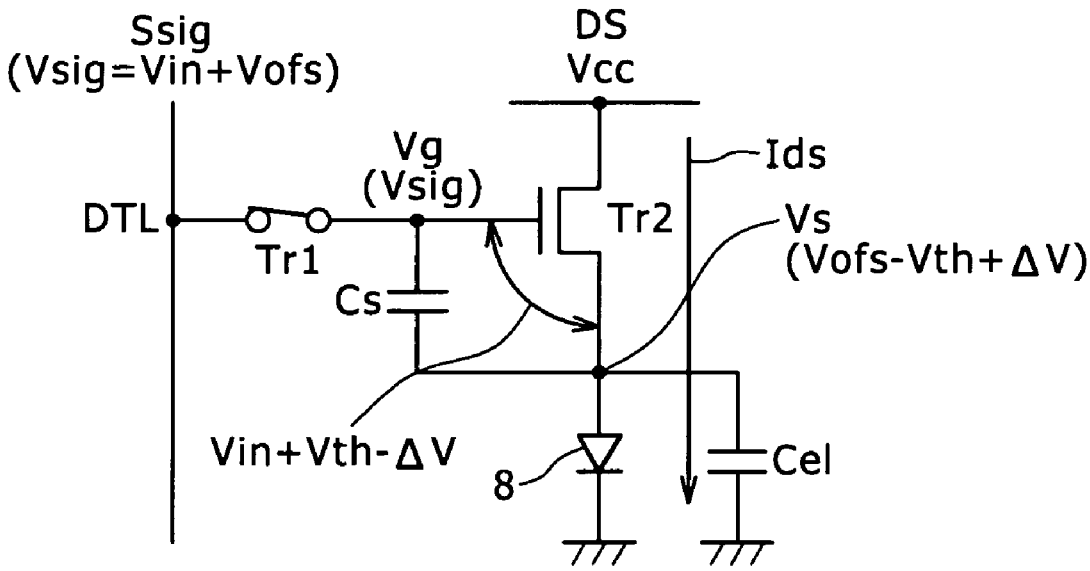
FIG. 10 is a connection diagram for describing the timing diagram continued from FIG. 9.

At time t4, the write transistor Tr1 is turned on (FIG. 4C). This sets the gate voltage Vg of the drive transistor Tr2 to the gray level setting voltage Vsig as illustrated in FIG. 10. As a result, the gate-to-source voltage Vgs of the drive transistor Tr2 is set to the voltage level which is the sum of the gray level voltage Vin and the threshold voltage Vth of the drive transistor Tr2. This makes it possible to effectively avoid the variation in the threshold voltage Vth of the drive transistor Tr2 in driving the organic EL element 8, thus preventing image quality degradation caused by the variation in light emission brightness of the organic EL element 8.

When the gate voltage Vg of the drive transistor Tr2 is set to the gray level setting voltage Vsig, the gate of the same transistor Tr2 is connected to the signal line DTL for a given period of time Tμ, with the drain voltage of the same transistor Tr2 maintained at the source voltage Vcc. This also corrects a mobility μ of the drive transistor Tr2 at the same time.

That is, if the write transistor Tr1 is turned on to connect the gate of the drive transistor Tr2 to the signal line DTL after the voltage across the holding capacitor Cs has been set to the threshold voltage Vth of the drive transistor Tr2, the gate voltage Vg of the same transistor Tr2 will increase gradually from the fixed voltage Vofs and eventually be equal to the gray level setting voltage Vsig.

Here, the writing time constant required for the gate voltage Vg of the drive transistor Tr2 to rise to high level is set shorter than the time constant required for the source voltage Vs of the same transistor Tr2 to rise to high level.

In this case, when the write transistor Tr1 turns on, the gate voltage Vg of the drive transistor Tr2 will quickly rise to the gray level setting voltage Vsig (Vofs+Vin). If the capacitance Cel of the organic EL element 8 is sufficiently larger than the capacitance of the holding capacitor Cs when the gate voltage Vg rises, the source voltage Vs of the drive transistor Tr2 will remain unchanged.

However, if the gate-to-source voltage Vgs of the drive transistor Tr2 increases beyond the threshold voltage Vth, the current Ids will flow through the same transistor Tr2, gradually increasing the source voltage Vs of the drive transistor Tr2. This discharges the voltage across the holding capacitor Cs, reducing the rate of increase of gate-to-source voltage Vgs.

This rate of discharge of the voltage across the holding capacitor Cs varies according to the capability of the drive transistor Tr2. More specifically, the larger the mobility μ of the same transistor Tr2, the higher the rate of discharge.

As a result, the larger the mobility μ of the drive transistor Tr2, the more the voltage across the holding capacitor Cs decreases, thus correcting the variation in light emission brightness caused by the variation in the mobility. It should be noted that the decrement of the voltage across the holding capacitor Cs relating to the correction of the mobility μ is denoted by ΔV in FIG. 10.

When the mobility correction time Tμ elapses, the write signal WS is pulled down to low level. This initiates the light emission period, causing the organic EL element 8 to emit light with the drive current Ids commensurate with the voltage across the holding capacitor Cs. It should be noted that when the light emission period begins, the gate voltage Vg and source voltage Vs of the drive transistor Tr2 will rise because of a so-called bootstrapping circuit.

As a result, the period from time t5 when the mobility correction time Tμ ends to t0 when the signal line DTL is set to the reference voltage Vini is assigned to the light emission period during which the organic EL element 8 emits light. Further, a preparation process is performed in two steps. This process sets the voltage across the holding capacitor Cs to a level equal to or greater than the threshold voltage Vth of the drive transistor Tr2. That is, a first preparation process pulls the drain voltage of the drive transistor Tr2 to low level at time t1. A second preparation process pulls the write signal WS to high level from time t2 to t3. Further, in a period of time during which the write signal WS is high from time t3 to t4, the voltage across the holding capacitor Cs is set to the threshold voltage Vth of the drive transistor Tr2, thus correcting the threshold voltage of the same transistor Tr2. Still further, the mobility of the drive transistor Tr2 is corrected, and the gray level setting voltage Vsig is sampled in a period of time from time t4 to t5.

It should be noted that the write signal WS may go high when the signal line DTL changes to the fixed voltage Vofs for variation correction rather than to the extinguishing reference voltage Vini. In this case, the extinguishing reference voltage Vini may be omitted so that the drive signal Ssig of the signal line DTL switches repeatedly between the gray level setting voltage Vsig and fixed voltage Vofs for variation correction.

(1-2) Unit Drive

Here, the light emission and non-light emission periods are initiated by the setting of the terminal voltage of the holding capacitor Cs in the pixel circuit 5. Therefore, control over the drain voltage of the drive transistor Tr2 is shared among a plurality of lines in the image display device 1, with the power drive signal DS set to the same level for the plurality of lines.

Here, FIGS. 1A to 1I are timing diagrams illustrating control over the successive scan lines in comparison with the drive signal Ssig of the signal lines DTL. In the example shown in FIG. 1, the display section 2 has the pixel circuits 5 grouped in units of three lines. In FIG. 1, the successive lines are denoted by 3n, 3n+1, 3n+2, 3(n+1), 3(n+1)+1, 3(n+1)+2, and so on for the grouping in units of three lines to show the relationship between the power drive signal DS and write signal WS. Further, three periods, i.e., the second preparation period, the period adapted to correct the threshold voltage of the drive transistor Tr2 and the period adapted to correct the variation in the mobility, are denoted by reference numerals A, B and C, respectively. It should be noted that each group is referred to as a unit.

The scan line drive circuit 4 generates write signals WS[3n], WS[3n+1], WS[3n+2], WS[3(n+1)], WS[3(n+1)+1] and WS[3(n+1)+2] (FIGS. 1A, 1C to 1E and 1G to 1I) so that the second preparation period A occurs at the same timing within each unit, but is delayed sequentially by three horizontal scan periods from one unit to the next.

The scan line drive circuit 4 generates the write signals WS[3n], WS[3n+1], WS[3n+2], WS[3(n+1)], WS[3(n+1)+1] and WS[3(n+1)+2] (FIGS. 1A, 1C to 1E and 1G to 1I) so that the period C adapted to correct the variation in the mobility and the timing at which to pull the extinguishing reference voltage Vini (refer to FIG. 4) to high level are delayed sequentially by one horizontal scan period between the successive lines within each unit and between units. This permits the image display device 1 to set the gray level for the pixel circuits 5 in a line sequential manner. It should be noted that, in FIG. 1, the period B adapted to correct the variation in the threshold voltage of the drive transistor Tr2 is also delayed sequentially by one horizontal scan period between the successive lines within each unit and between units. However, the period B may be set to occur at the same timing within each unit.

The scan line drive circuit 4 generates power drive signals DS[3n] and DS[(3n+1)] for each unit. More specifically, the same circuit 4 generates these signals so that the source voltage Vcc is supplied to the drive transistor Tr2 from immediately before the first period B for the first line within each unit to the completion of pulling the extinguishing reference voltage Vini up to high level in the last line within each unit.

The scan line drive circuit 4 pulls the power drive signals DS[3n] and DS[(3n+1)] up to the source voltage Vcc at a time other than when one of the terminals of the holding capacitor Cs is connected to the signal line DTL by the write signal WS in the pixel circuits 5 in other lines. More specifically, in the example shown in FIG. 1, the scan line drive circuit 4 pulls the power drive signals DS[3n] and DS[(3n+1)] up to the source voltage Vcc when the signal line DTL is pulled down to the fixed voltage Vofs. As a result, the display section 2 sets the pixel circuits 5 of interest to the gray level setting voltage Vsig first and then pulls the power drive signals DS up to high level.

After pulling the power drive signals DS up to high level, the scan line drive circuit 4 pulls the write signals WS up to high level to initiate the periods B.

(1-3) Pixel Circuit Layout

Figure 11:
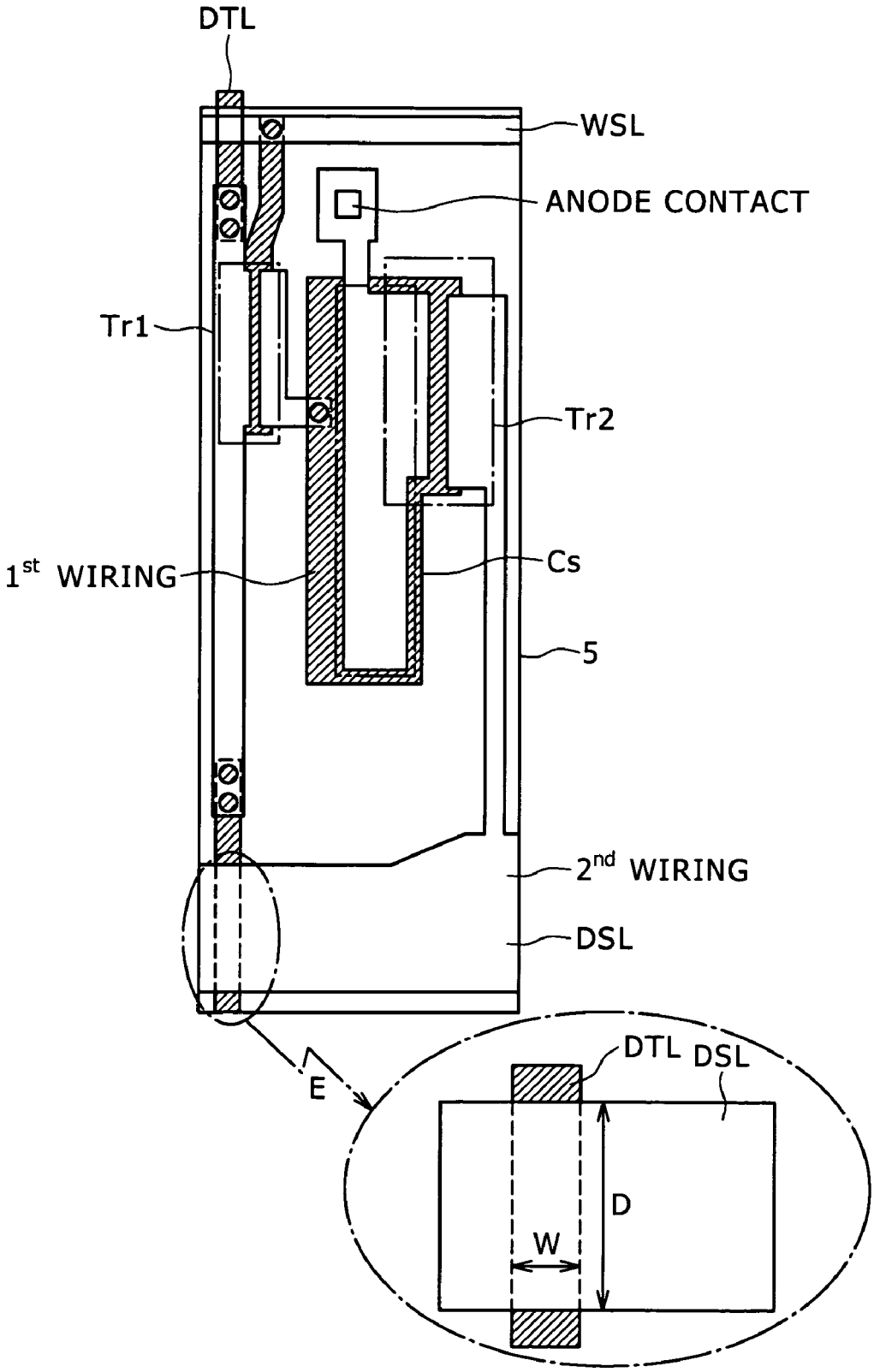
FIG. 11 is a plan view illustrating the layout of the pixel circuits shown in FIG. 3.
Figures 12A, 12B, 12C, 12D, 12E, 12F, 12G, 12H, 12I:
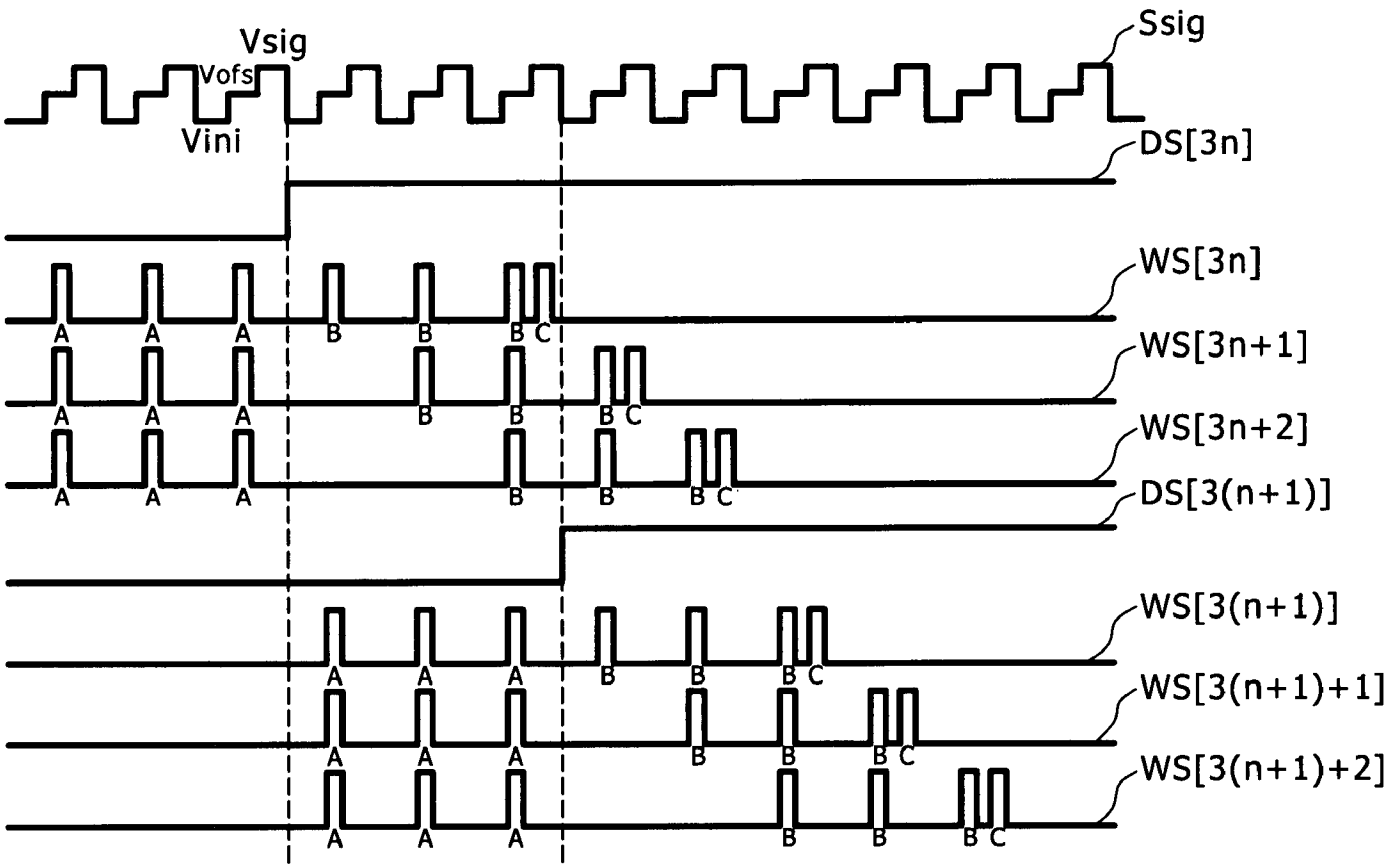
FIGS. 12A to 12I are timing diagrams for describing the change in potential of a signal line.
Figures 13A, 13B, 13C, 13D, 13E, 13F, 13G:
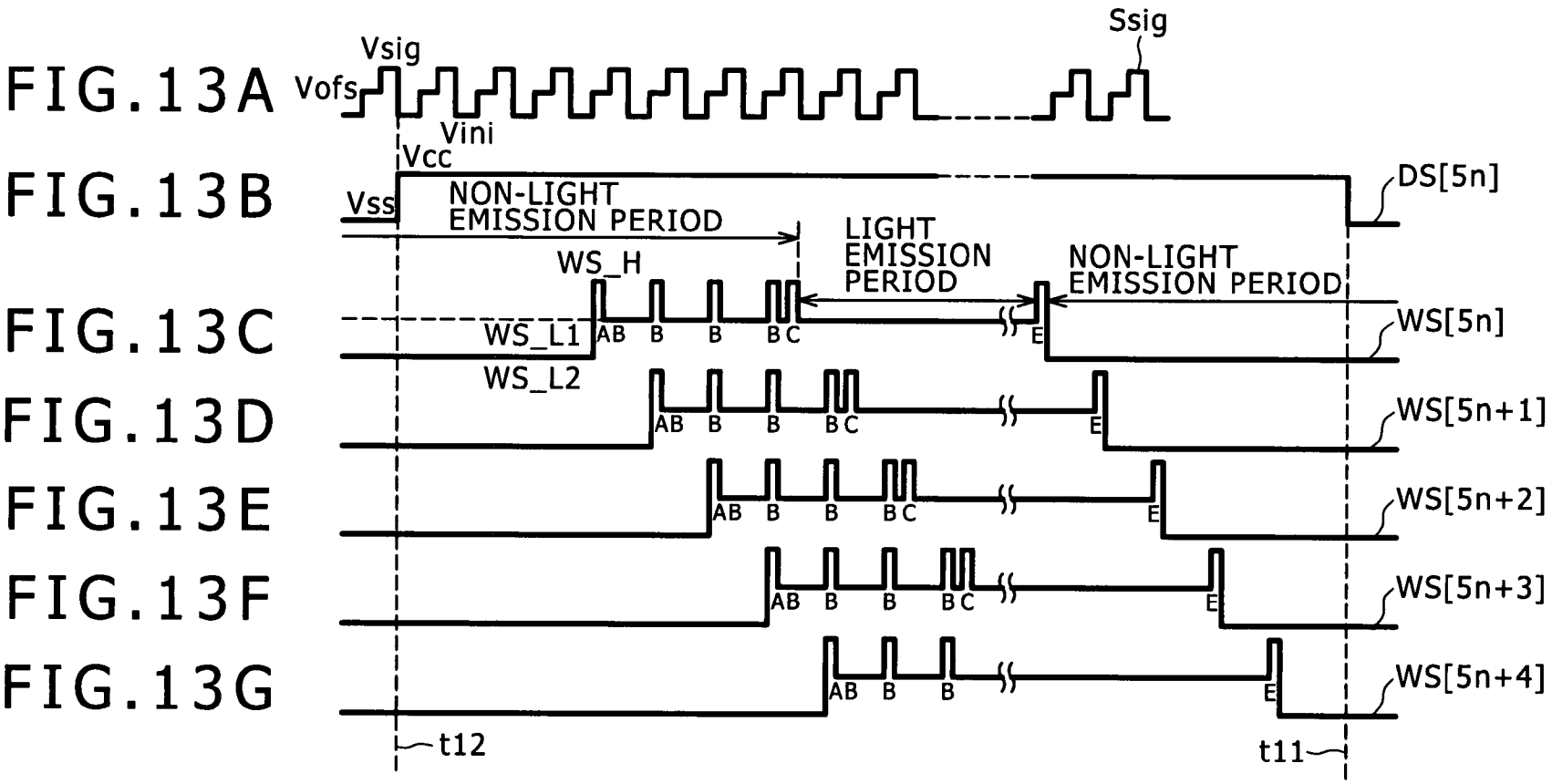
FIGS. 13A to 13G are timing diagrams for describing the operation of an image display device according to another embodiment of the present invention.
Figures 14A, 14B, 14C, 14D, 14E, 14F, 14G:
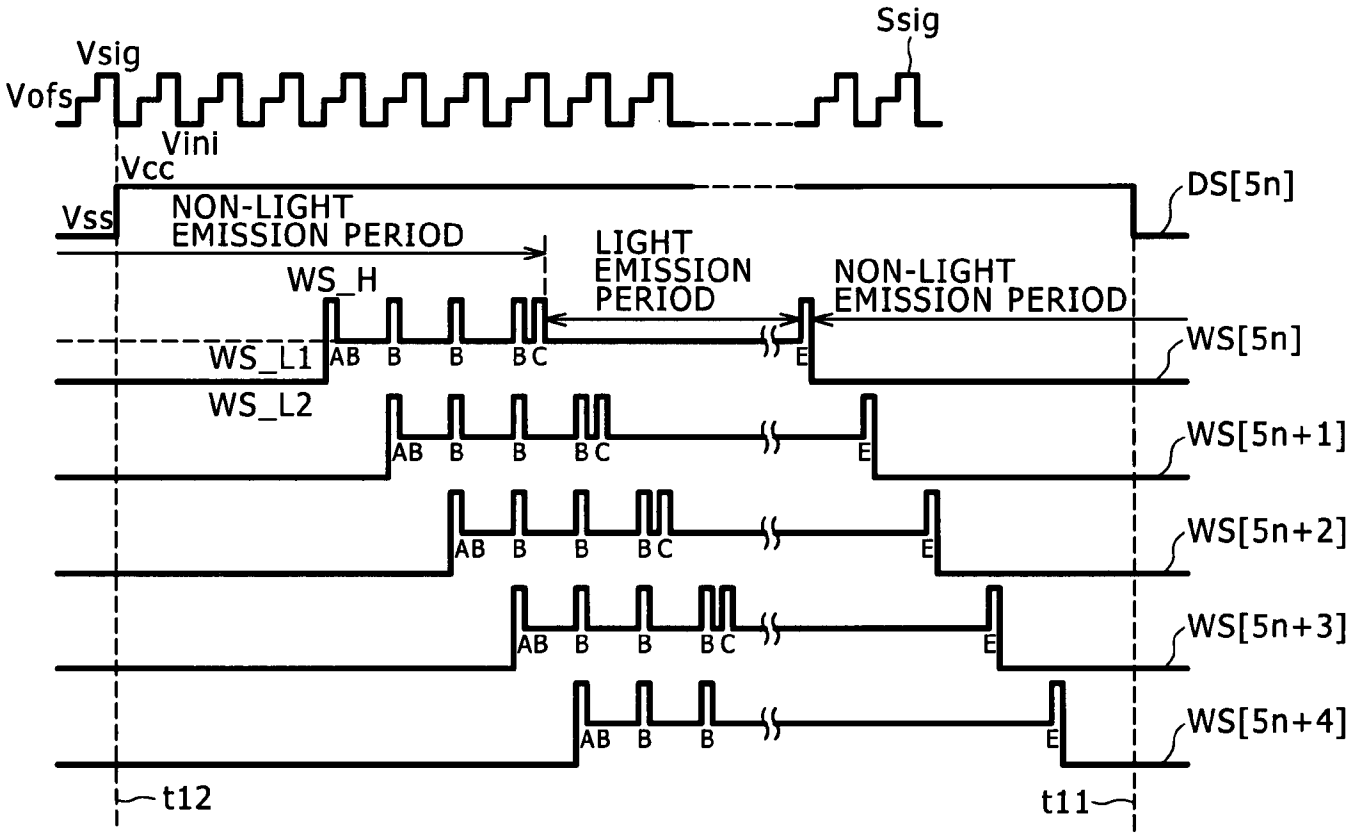
FIGS. 14A to 14G are timing diagrams for describing the operation of an image display device according to another embodiment of the present invention.

FIG. 11 is a plan view illustrating the layout of the pixel circuits 5. FIG. 11 is a plan view as seen from the substrate side, with the members in the layers overlying the anode electrode removed. In this figure, the first wiring pattern is shown hatched. The circle shows the contact between different layers. The wiring pattern is also shown hatched inside the circle to illustrate the connection relationship between different layers.

In order to form the pixel circuits 5, a wiring pattern material layer is deposited on an insulating substrate made, for example, of glass after which the wiring pattern material layer is etched to form a first wiring. Next, a gate oxide film is formed, followed by the formation of an intermediate wiring layer using a polysilicon film. Then, a channel protection layer and other layers are formed, followed by doping with impurity to form the transistors Tr1 and Tr2.

Next, a wiring pattern material layer is deposited, followed by etching to form a second wiring. The power scan lines DSL and write signal scan lines WSL are formed with the second wiring. The power scan lines DSL are formed wider than the write signal scan lines WSL. The signal lines DTL are formed, to the extent possible, with the second wiring. More specifically, the signal lines DTL are formed with the first wiring where they intersect the scan lines DSL or WSL. The remaining portions of the signal lines DTL are formed with the first wiring. As a result, contacts between the first and second wirings are provided on both sides of the intersections between the signal lines DTL and scan lines DSL and WSL.

In the pixel circuit 5, therefore, the signal line DTL and the scan line of the power drive signal DS overlap each other over the portion having an area of W by D, where W is the width of the signal line DTL and D the width of the scan line of the power drive signal DS.

(2) Operation of the Embodiment

In the image display device 1 configured as described above, the signal line drive circuit 3 divides the sequentially fed image data D1 among the signal lines DTL and converts each piece of the digital image data D1 into analog data, thus generating the gray level voltage Vin for each of the signal lines DTL. The same voltage Vin specifies the gray level of each of the pixel circuits connected to the signal lines DTL. The scan line drive circuit 4 drives the display section 2, setting the pixel circuits 5 making up the display section 2 to the gray level voltage Vin, for example, in a line sequential manner. Further, the organic EL element 8 emits light at the brightness commensurate with the gray level voltage Vin in each of the pixel circuits 5. This permits an image to be displayed according to the image data D1 on the display section 2.

More specifically, the organic EL element 8 is current-driven by the drive transistor Tr2 having a source follower configuration in the pixel circuit 5 (FIG. 3). The voltage of the gate-side terminal of the holding capacitor Cs, provided between the gate and source of the drive transistor Tr2, is set to the voltage Vsig commensurate with the gray level voltage Vin. This permits the organic EL element 8 to emit light at the brightness commensurate with the gray level data D1, thus displaying a desired image on the image display device 1.

However, the drive transistor Tr2 used in each of the pixel circuits 5 is disadvantageous in that there is a significant variation in the threshold voltage Vth. Therefore, if the voltage of the gate-side terminal of the holding capacitor Cs is set simply to the voltage Vsig commensurate with the gray level voltage Vin, the variation in the threshold voltage Vth of the drive transistor Tr2 leads to a variation in the light emission brightness of the organic EL element 8, thus resulting in image quality degradation.

In the image display device 1, therefore, the voltage of the terminal of the holding capacitor Cs on the side of the organic EL element 8 is pulled down to low level first. Then, the gate voltage of the drive transistor Tr2 is set to the fixed voltage Vofs for threshold voltage correction via the write transistor Tr1 (FIG. 4). This sets the voltage across the holding capacitor Cs to a level equal to or greater than the threshold voltage Vth of the drive transistor Tr2. Then, the voltage across the holding capacitor Cs is discharged via the drive transistor Tr2. This series of processes sets the voltage across the holding capacitor Cs to the threshold voltage Vth of the drive transistor Tr2 in advance.

Then, the gray level setting voltage Vsig is set to the gate voltage of the drive transistor Tr2. The gray level setting voltage Vsig is the sum of the gray level voltage Vin and fixed voltage Vofs. This prevents image quality degradation caused by the variation in the threshold voltage Vth of the drive transistor Tr2.

Further, with power supplied to the drive transistor Tr2 for a given period of time, the gate voltage of the drive transistor Tr2 is maintained at the gray level setting voltage Vsig. This prevents image quality degradation caused by the variation in the mobility of the drive transistor Tr2.

However, there are cases in which enough time may not be assigned to the discharge of the voltage across the holding capacitor Cs via the drive transistor Tr2. In such a case, the image display device may not set the voltage across the holding capacitor Cs to the threshold voltage Vth of the drive transistor Tr2 with sufficient accuracy. This may make it impossible to sufficiently correct the same voltage Vth.

In the present embodiment, therefore, the voltage across the holding capacitor Cs is discharged in a plurality of times via the drive transistor Tr2. This provides enough time to discharge the voltage across the holding capacitor Cs via the drive transistor Tr2. This allows for ample correction of the mobility of the drive transistor Tr2 even in the case of enhanced resolution.

The light emission periods of the pixel circuits 5 begin in the image display device 1 when the voltage across the holding capacitor Cs is set by the correction of the variation in mobility. In the same device 1, the voltage across the holding capacitor Cs is set in the same manner using the extinguishing reference voltage Vini. As a result, the light emission periods of the pixel circuits 5 are initiated by controlling the write signals WS, thus making it possible to share the power drive signal DS among a plurality of lines.

However, sharing a scan line drive signal among a plurality of lines as described above leads to a higher capacitance of the signal lines DTL for a drive signal. This higher capacitance will adversely affect the signal lines DTL.

More specifically, we assume that the power scan line and the signal line DTL overlap each other over the portion having an area of W by D as illustrated in FIG. 11. If the power drive signal DS is shared among three lines, then the capacitance of the signal lines DTL for each of the power drive signals DS will increase three-fold. As a result, the impact of the power drive signal DS on the drive signal Ssig will increase three-fold.

In particular, the power drive signal DS is the drive current flowing through the organic EL element 8. As a result, the scan lines must be formed wide. Therefore, if the power drive signal DS is shared among a plurality of lines, the signal lines DTL will be significantly affected.

FIGS. 12A to 12I are timing diagrams illustrating, in comparison with FIGS. 1A to 1I and without considering any impact on the signal lines DTL, a case in which successive lines are driven. To facilitate the understanding, FIGS. 12A to 12I illustrate a case in which the power drive signal DS is shared among the two successive lines.

In this case, the signal level of the signal line DTL changes temporarily as a result of the rising of the power drive signal DS as illustrated by reference numeral F because of the capacitance between the signal line DTL and the scan line of the power drive signal DS. As a result, the gray level may not be set properly in the pixel circuit 5 of interest (pixel circuit whose gray level is set by a write signal WS[2n+1]). This temporary change in the signal level occurs each time the power drive signal WS rises. Therefore, the display device is unable to set the gray level properly for the plurality of lines relating to the rising of the power drive signal DS, thus resulting in horizontal streaks.

In the present embodiment, therefore, the power drive signal DS is shared among a plurality of lines, and the power drive signal DS is pulled to high level at a time other than when one of the terminals of the holding capacitor Cs is connected to the signal line DTL by the write signal WS in the pixel circuits 5 in other lines (FIG. 1). This ensures that the gray level setting in the pixel circuits 5 is unaffected by the variation in signal level of the signal line DTL, thus allowing for proper setting of the gray level in the same circuits 5.

Further, in the present embodiment, the power drive signal DS is pulled up to high level when the voltage of the signal line DTL is pulled down from the gray level setting voltage Vsig to the fixed voltage Vofs for threshold voltage correction. Therefore, the power drive signal DS is pulled up to high level after the gray level has been set. As a result, the gray level setting of the pixel circuits 5 remains unaffected by the power drive signal DS. Still further, the rise in signal level of the power drive signal DS is cancelled out by the fall in signal level of the signal line DTL. This also ensures that the gray level setting of the pixel circuits 5 remains unaffected by the power drive signal DS.

(3) Effect of the Embodiment

The present embodiment configured as described above pulls the power drive signal up to high level at a time other than when the write signal is high. This permits the gray level to be set properly for each pixel circuit even if pixel circuit control using scan lines is shared among a plurality of lines.

Further, the voltage across the holding capacitor is set first to a level equal to or greater than the threshold voltage of the drive transistor. Next, this voltage is set to a level commensurate with the threshold voltage of the drive transistor. Then, the terminal voltage of the holding capacitor is set to the signal line voltage to initiate the light emission period. This makes it possible to effectively avoid the variation in the threshold voltage of the drive transistor, thus providing enhanced image quality.

Still further, the fixed voltage adapted to correct the variation in the threshold voltage of the drive transistor is output to the signal line. This fixed voltage for variation correction is used to set the terminal voltage of the holding capacitor to a voltage level equal to or greater than the threshold voltage of the drive transistor. A simple configuration effectively avoids the variation in the threshold voltage of the drive transistor, thus providing improved image quality.

Still further, the power drive signal is pulled up to high level when the voltage of the signal line is pulled down to low level. As a result, the rise in signal level of the power drive signal is cancelled out by the fall in signal level of the signal line, contributing to even higher accuracy for setting the gray level of the pixel circuits.

Embodiment 2

FIGS. 13A to 13G are timing diagrams for describing, in comparison with FIG. 1, the operation of an image display device according to embodiment 2 of the present invention. The image display device according to the present embodiment generates the drive signal Ssig of the signal line DTL in such a manner that the same signal Ssig changes in voltage level in order of the extinguishing fixed voltage Vini, fixed voltage Vofs for threshold voltage variation correction and gray level setting voltage Vsig. This provides a greater difference in signal level when the drive signal Ssig is pulled down to low level than in embodiment 1.

The image display device according to the present embodiment generates the write signals WS and drive signal DS according to the setting of the drive signal Ssig of the signal line DTL. The image display device according to the present embodiment is configured in the same manner as that according to embodiment 1 except for the above difference relating to the above signals.

In the present embodiment, the difference in signal level is greater when the drive signal is pulled down to low level than in embodiment 1. As a result, the rise in signal level of the power drive signal is more positively cancelled out by the fall in signal level of the signal line, providing further higher accuracy in setting the gray level of the pixel circuits.

Embodiment 3

FIGS. 14A to 14G are timing diagrams for describing, in comparison with FIGS. 13A to 13G, the operation of an image display device according to embodiment 3 of the present invention. As with the display device according to embodiment 2, the image display device according to the present embodiment generates the drive signal Ssig of the signal line DTL in such a manner that the same signal Ssig changes in voltage level in order of the fixed voltage Vini, fixed voltage Vofs and gray level setting voltage Vsig. The image display device shown in FIGS. 14A to 14G has the pixel circuits 5 grouped in units of five lines.

The image display device according to the present embodiment generates the write signals WS and drive signal DS according to the setting of the drive signal Ssig of the signal line DTL. The image display device according to the present embodiment is configured in the same manner as that according to embodiment 2 except for the above difference relating to the signals.

In this image display device, a second low level is provided for the write signal WS which is lower than the original low level of the same signal WS used in the image display devices described above. That is, the write signal WS assumes three different voltage levels denoted by WS H, WS L1 and WS L2. In the image display device, the write signals WS are sequentially pulled up to the high level voltage WS H when the signal line DTL is set to the extinguishing fixed voltage Vini as shown by reference numeral E, thus turning on the write transistor Tr1. Then, the write signals WS are pulled down to the second low level voltage WS L2, turning off the write transistor Tr1 and causing the pixel circuits 5 to stop emitting light in a line sequential manner.

In a predetermined period of time after the non-light emission period begins, the power drive signal DS supplied to this unit is pulled down to the voltage Vss as shown at time t11. As a result, the image display device performs the first preparation for threshold voltage variation correction of the drive transistor Tr2.

Then, with the light emission period approaching after the elapse of a given period of time, the power drive signal DS is pulled up to the source voltage Vcc when none of the write signals WS are at the high level voltage WS H and when the signal line DTL is pulled down to low level as shown at time t12.

Further, the write signals WS are pulled up to the high level voltage WS H at timings sequentially shifted from each other and for a plurality of periods during which the signal line DTL is set to the fixed voltage Vofs for threshold voltage variation correction as shown by reference numerals AB and B. This turns on the write transistor Tr1, thus allowing the threshold voltage correction to be performed. Here in the example shown in FIGS. 14A to 14G, when the write signals WS are pulled up to the high level voltage WS H for the first time, the gate-side terminal voltage Vg of the holding capacitor Cs rises to the fixed voltage Vofs as shown by reference numeral AB. This allows the second preparation to be performed for correcting the variation in threshold voltage of the drive transistor Tr2. As a result, the second preparation and the correction of the variation in the threshold voltage are performed when the write signals WS are pulled up to the high level voltage WS H for the first time.

Then, the image display device turns on the write transistor Tr1 as shown by reference numeral C, correcting the variation in mobility of the drive transistor Tr2 and sampling and holding the gray level voltage Vin to initiate the light emission period. It should be noted that, in the present embodiment, the write signals WS are set to the first low level voltage WS L1 during the periods of time between the threshold voltage corrections (reference numerals AB and B) and those from the last threshold voltage correction to the mobility correction (reference numeral C).

The present embodiment provides the same advantageous effects as the above embodiments even if the second preparation and the correction of the variation in the threshold voltage are performed when the write signal is pulled up to high level for the first time after the power drive signal is pulled up to high level in advance.

Embodiment 4

In the above embodiments, a case has been described in which the signal line DTL is switched between the extinguishing fixed voltage Vini, fixed voltage Vofs for threshold voltage variation correction and gray level setting voltage Vsig. However, the present invention is not limited thereto, but the extinguishing fixed voltage Vini may be replaced by the fixed voltage Vofs for threshold voltage variation correction.

Further, in the above embodiments, a case has been described in which setting of the voltage across the holding capacitor to the threshold voltage of the drive transistor is accomplished in three or four periods. However, the present invention is not limited thereto, but is also widely applicable to other cases including those in which the setting is accomplished in a plurality of periods greater than three or four and in a single period.

Still further, in the above embodiments, a case has been described in which the non-light emission period is initiated by setting the extinguishing fixed voltage or fixed voltage for threshold voltage variation correction once. However, the present invention is not limited thereto, but the non-light emission period may be initiated by repeating the setting a plurality of times.

Still further, in the above embodiments, a case has been described in which the variation in the threshold voltage of the drive transistor is corrected by setting the terminal voltage of the holding capacitor via the signal line. However, the present invention is not limited thereto, but is also widely applicable to other cases including those in which the variation in the threshold voltage of the drive transistor is corrected by setting the terminal voltage of the holding capacitor using, for example, a dedicated power source and dedicated switching transistor.

Still further, in the above embodiments, a case has been described in which an N-channel transistor is used as the drive transistor. However, the present invention is not limited thereto, but is also widely applicable to an image display device in which a P-channel transistor is used as the drive transistor.

Still further, in the above embodiments, a case has been described in which the present invention is applied to an image display device using organic EL elements. However, the present invention is not limited thereto, but is also widely applicable to image display devices using a variety of current-driven self-luminous light-emitting elements.

The present invention relates to an image display device and driving method of the same and is applicable, for example, to an active matrix image display device using organic EL elements.

The present application contains subject matter related to that disclosed in Japanese Priority Patent Application JP 2008-179723 filed in the Japan Patent Office on Jul. 10, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image display device comprising:

a display section formed by arranging pixel circuits in a matrix form, each of the pixel circuits including at least:

a light emitting element;

a drive transistor adapted to current-drive the light-emitting element with a drive current commensurate with a gate-to-source voltage in response to a power drive signal applied to a drain of the drive transistor via a power scan line;

a holding capacitor adapted to hold the gate-to-source voltage; and a write transistor adapted to be controlled by a write signal supplied via a write signal scan line to connect a terminal of the holding capacitor to a signal line so as to set a terminal voltage of the holding capacitor to a signal line voltage;

wherein:

a light emission period during which the light-emitting element emits light, and non-light emission period during which the light-emitting element does not emit light, are alternately repeated;

a light emission period start voltage adapted to at least start the light emission period, and a non-light emission period start voltage adapted to start the non-light emission period, are alternately output to the signal line;

the terminal voltage of the holding capacitor is set by controlling the write transistor using the write signal so as to start the light emission period and the non-light emission period;

the write signal is set in such a manner as to sequentially delay timings at which to set the light emission period start voltage between successive lines;

the power drive signal is commonly set in units of the successive lines; and a drain voltage of the drive transistor is pulled up to high level using the power drive signal at a time other than when the terminal of the holding capacitor is connected to the signal line by the write signal in the pixel circuits in different lines.

2. The image display device according to claim 1, wherein in the pixel circuit, the gate-to-source voltage is set to a level equal to or greater than the threshold voltage of the drive transistor by controlling the write transistor with the write signal, and next, the gate-to-source voltage is set is set to a level commensurate with the threshold voltage of the drive transistor; and then, the terminal voltage of the holding capacitor is set to the signal line voltage to initiate the light emission period.

3. The image display device according to claim 2, wherein a correction voltage adapted to correct the variation in the threshold voltage of the drive transistor is further output to the signal line; and the gate-to-source voltage is set to a voltage level equal to or greater than the threshold voltage of the drive transistor by pulling the drain voltage of the drive transistor to low level with the power drive signal and by setting the terminal voltage of the holding capacitor to the correction voltage by controlling the write transistor with the write signal.

4. The image display device according to claim 1, wherein the power drive signal is pulled up to high level when the signal line voltage is pulled down to low level.

5. An image display device comprising:

display means formed by arranging pixel circuits in a matrix form, each of the pixel circuits including at least:

a light emitting element;

a drive transistor adapted to current-drive the light-emitting element with a drive current commensurate with a gate-to-source voltage in response to a power drive signal applied to a drain of the drive transistor via a power scan line;

a holding capacitor adapted to hold the gate-to-source voltage; and a write transistor adapted to be controlled by a write signal supplied via a write signal scan line to connect a terminal of the holding capacitor to a signal line so as to set a terminal voltage of the holding capacitor to a signal line voltage;

wherein:

a light emission period during which the light-emitting element emits light, and non-light emission period during which the light-emitting element does not emit light, are alternately repeated;

a light emission period start voltage adapted to at least start the light emission period, and a non-light emission period start voltage adapted to start the non-light emission period, are alternately output to the signal line;

the terminal voltage of the holding capacitor is set by controlling the write transistor using the write signal so as to start the light emission period and the non-light emission period;

the write signal is set in such a manner as to sequentially delay timings at which to set the light emission period start voltage between successive lines;

the power drive signal is commonly set in units of the successive lines; and a drain voltage of the drive transistor is pulled up to high level using the power drive signal at a time other than when the terminal of the holding capacitor is connected to the signal line by the write signal in the pixel circuits in different lines.

* * * * *